US012066259B2

(12) United States Patent
Wang

(10) Patent No.: US 12,066,259 B2
(45) Date of Patent: Aug. 20, 2024

(54) HEAT EXCHANGER

(71) Applicant: JUN HE TECHNOLOGY CO., LTD., Changhua County (TW)

(72) Inventor: Chiang-Chuan Wang, Fuxing Township, Changhua County (TW)

(73) Assignee: JUN HE TECHNOLOGY CO., LTD., Changhua County (TW)

( * ) Notice: Subject to any disclaimer, the term of this patent is extended or adjusted under 35 U.S.C. 154(b) by 188 days.

(21) Appl. No.: 17/503,342

(22) Filed: Oct. 17, 2021

(65) Prior Publication Data

US 2023/0117428 A1 Apr. 20, 2023

(51) Int. Cl.
*F28F 3/14* (2006.01)
*F28D 9/00* (2006.01)

(52) U.S. Cl.
CPC ..... *F28F 3/14* (2013.01); *F28D 9/0037* (2013.01); *F28F 2210/10* (2013.01)

(58) Field of Classification Search
CPC ..... F28F 3/14; F28F 2210/10; F28F 3/086; F28D 9/0037
USPC ..... 165/170
See application file for complete search history.

(56) References Cited

U.S. PATENT DOCUMENTS

| | | | | |
|---|---|---|---|---|
| 5,544,703 | A * | 8/1996 | Joel | F28F 21/02 165/166 |
| 6,357,396 | B1 * | 3/2002 | Stansfield | F28F 3/042 165/166 |
| 7,258,162 | B2 * | 8/2007 | Shibata | F28D 9/0037 165/170 |
| 7,851,080 | B2 * | 12/2010 | Weber | H01M 10/651 429/514 |
| 10,371,461 | B2 * | 8/2019 | Chainer | F28D 15/00 |
| 10,641,558 | B2 * | 5/2020 | Chainer | F28D 15/00 |
| 10,962,308 | B2 * | 3/2021 | Sjödin | F24S 10/503 |
| 11,400,532 | B2 * | 8/2022 | Boehnke | F28D 9/0056 |
| 11,573,057 | B2 * | 2/2023 | Colugnati | F28D 1/0325 |
| 2021/0270536 | A1 * | 9/2021 | Suzuki | F28D 9/04 |
| 2021/0292159 | A1 * | 9/2021 | Zhao | F28F 21/081 |
| 2022/0281353 | A1 * | 9/2022 | Cheadle | F28D 1/0358 |

* cited by examiner

*Primary Examiner* — Jon T. Schermerhorn, Jr.

(57) ABSTRACT

A heat exchanger has a plurality of metal plates, each metal plate having two contacting surfaces, at least one of the contacting surfaces having a fluid channel and abutting against another metal plate, at least two metal plates connected together with the contacting surfaces facing each other. High temperature is used to melt at least two metal plates together, so that the metal plates can be combined without additional locking or welding.

7 Claims, 4 Drawing Sheets

HEAT EXCHANGER

BACKGROUND OF INVENTION

Field of Invention

The present invention relates to a heat exchanger, and more particularly to a heat exchanger employing the metal plates.

Description of the Related Art

During the operation of the machinery, some of the units need to be heated by fluid, and some must be cooled to adapt to the operating conditions of the unit. The heat exchange process is usually carried out by the heat exchanger, and the typical heat exchanger is a device that allows two fluids to exchange heat. Moreover, the plate-type heat exchanger is the most common type at current market.

The plate-type heat exchanger is composed of high-efficiency heat transfer corrugated plates and a frame. Each plate is clamped by bolts between the front plates and the rear plate of the frame, and rubber gaskets are employed between the plates for sealing.

However, the above conventional structure still has the following problems in practical applications: the plates need to be aligned one by one before they can be locked with bolts, therefore, the installation is time-consuming and labor-intensive; also, the rubber gaskets are required to be installed between each plate, which causes high cost and complicated installation; last, the rubber gaskets cannot resist high pressure and acid or alkali, so it limits the use of heat exchangers from high pressure or chemical fields.

Therefore, it is desirable to provide a heat exchanger to mitigate and/or obviate the aforementioned problems.

SUMMARY OF THE INVENTION

An objective of present invention is to provide a heat exchanger.

To achieve these and other objects of the present invention, a heat exchanger has a plurality of metal plates, each metal plate having two contacting surfaces, at least one of the contacting surfaces having a fluid channel and abutting against another metal plate, at least two metal plates connected together with the contacting surfaces facing each other. High temperature is used to melt at least two metal plates together, so that the metal plates can be combined without additional locking or welding.

Other objects, advantages, and novel features of invention will become more apparent from the following detailed description when taken in conjunction with the accompanying drawings.

DETAILED DESCRIPTION OF THE PREFERRED EMBODIMENT

Figure 1:
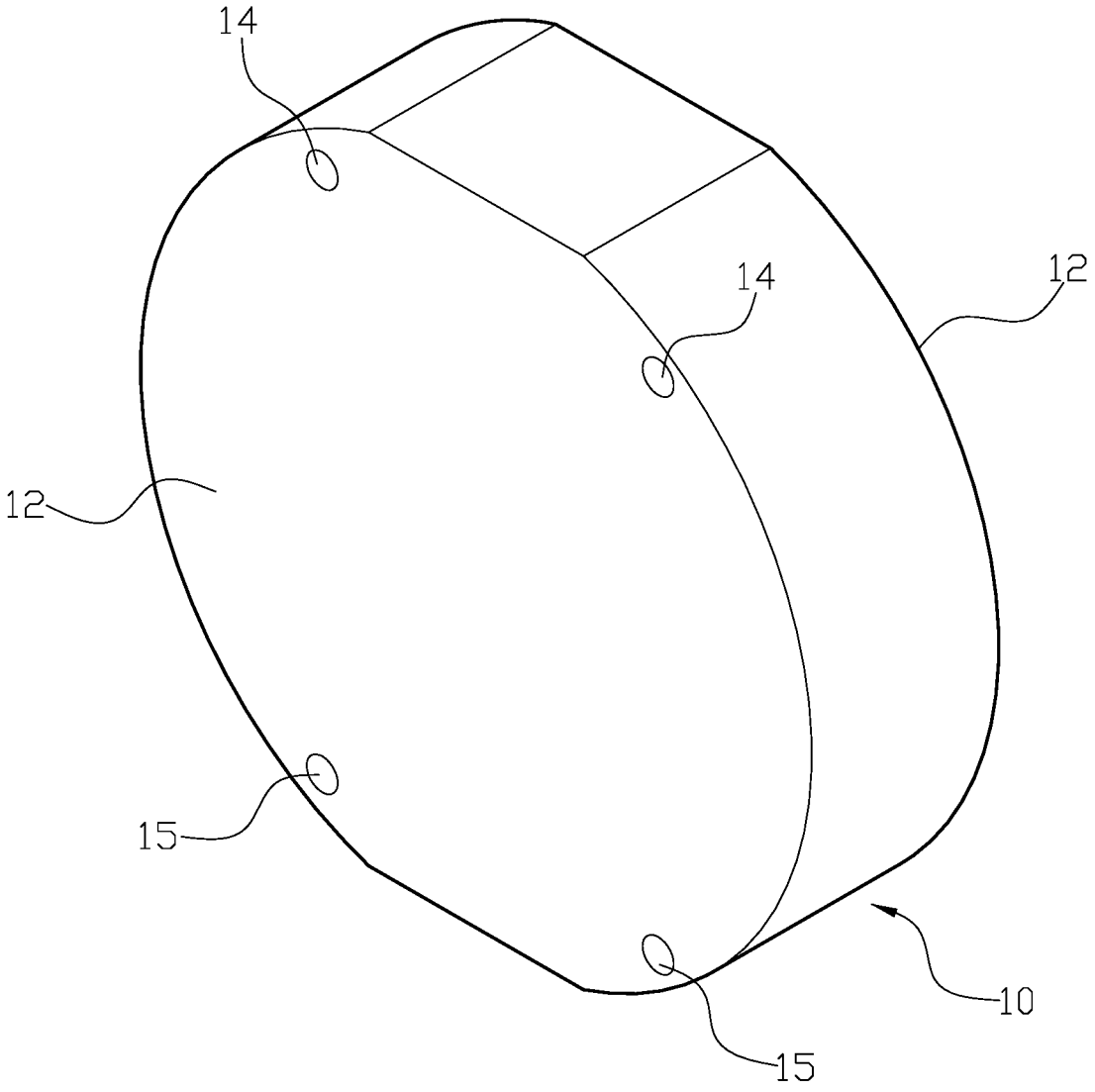
FIG. 1 is a perspective view of a preferred embodiment according to the present invention.
Figure 2:
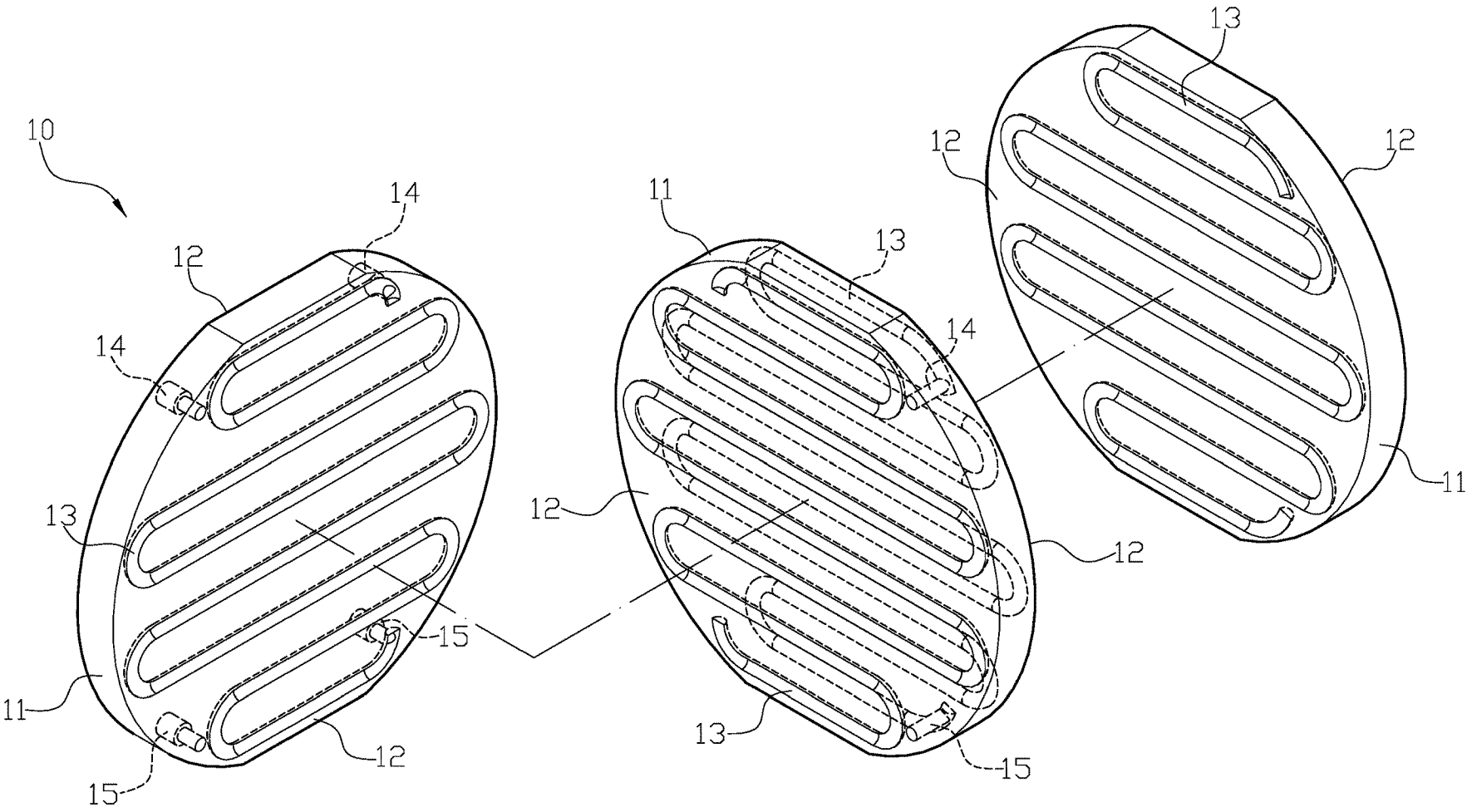
FIG. 2 is a perspective view of the metal plates facing each other in the preferred embodiment according to the present invention.
Figure 4:
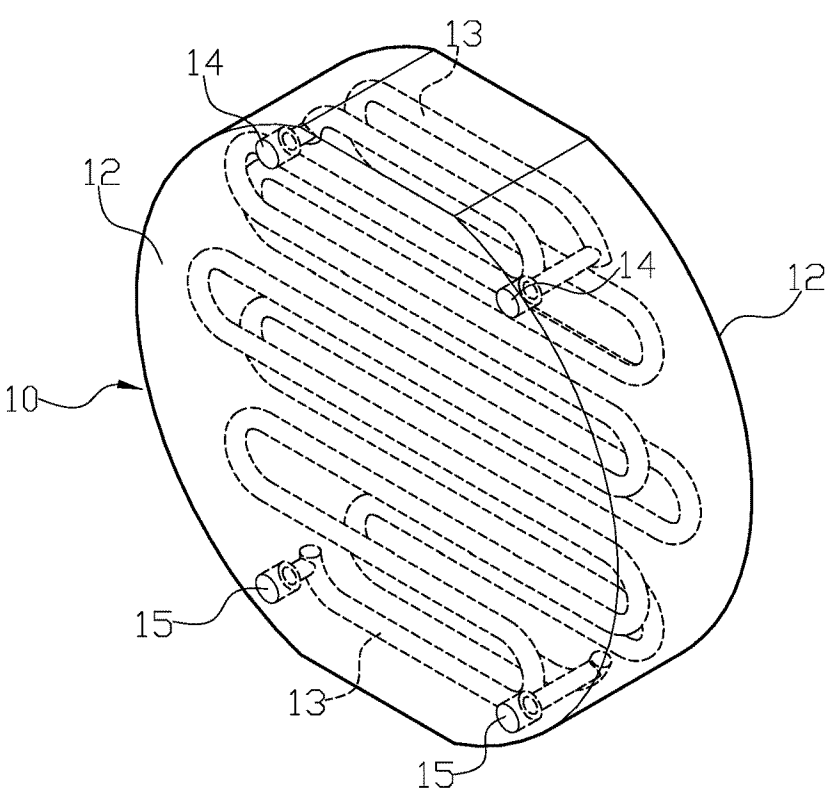
FIG. 4 is a status drawing of the metal plates being welded together at high temperature in the preferred embodiment according to the present invention.
Figure 3:
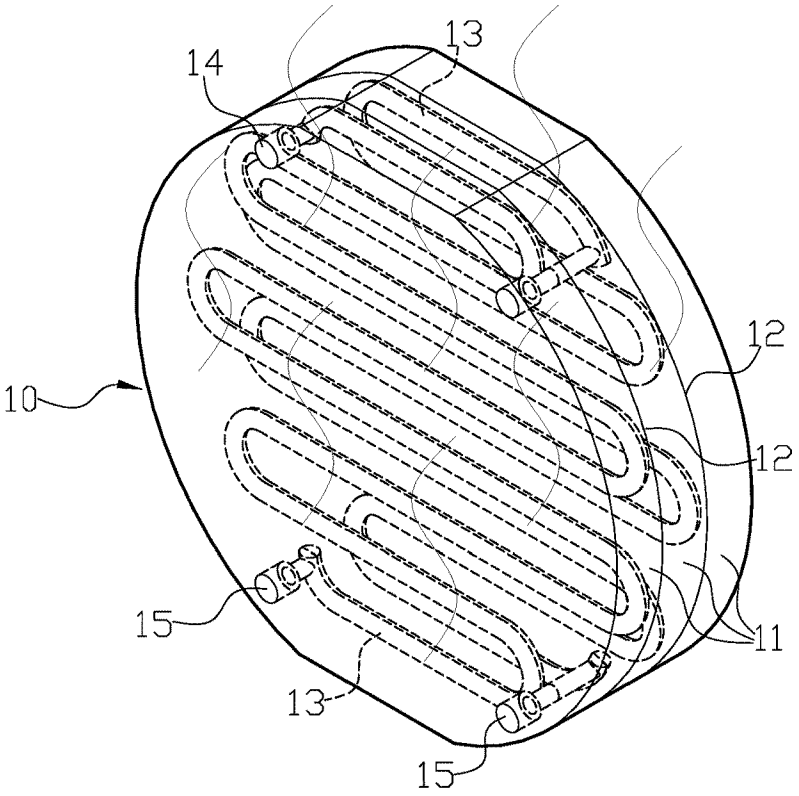
FIG. 3 is a status drawing using high temperature for heating and welding in the preferred embodiment according to the present invention.
Figure 5:
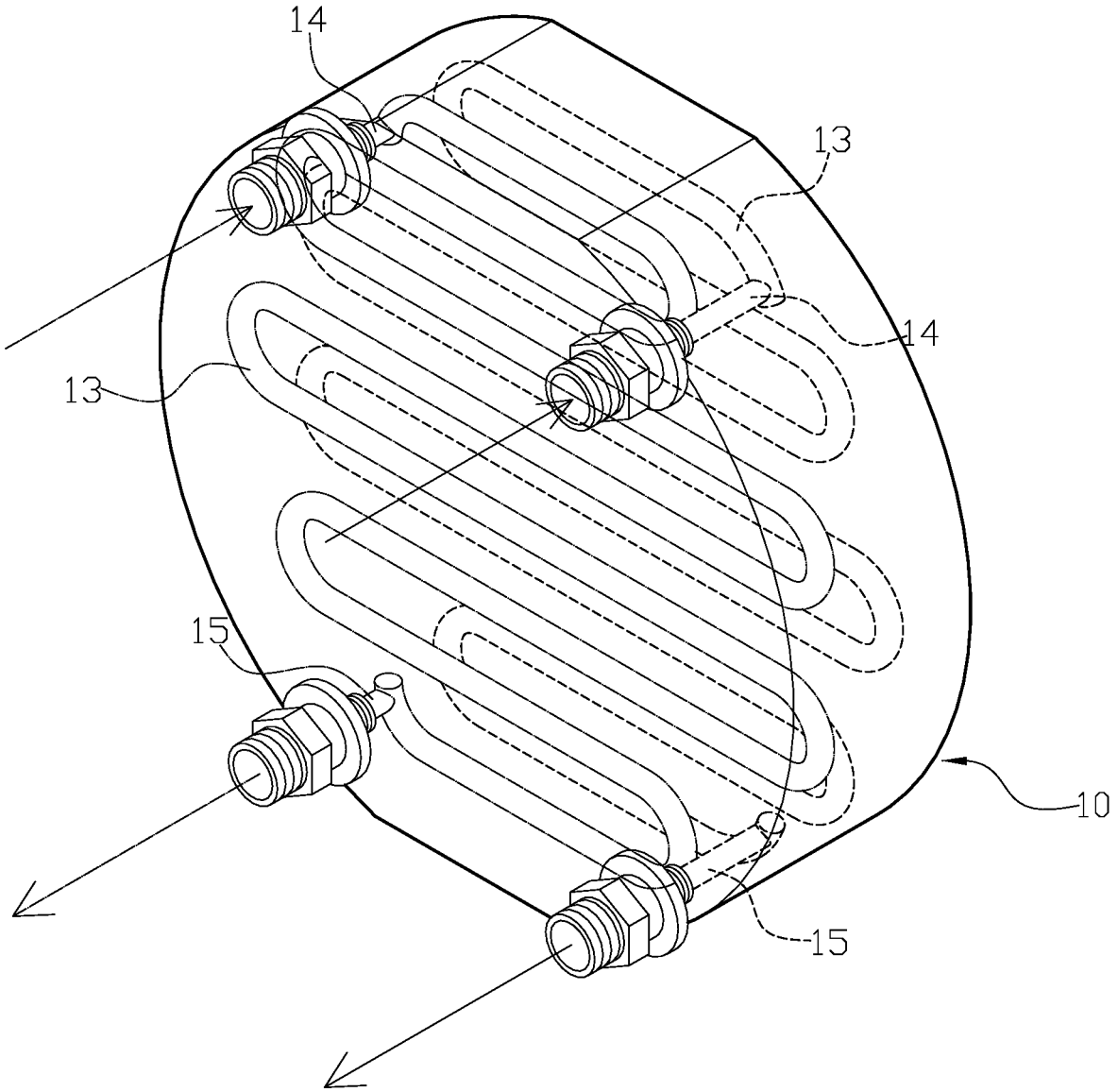
FIG. 5 is a drawing of the delivery state of the fluid in the preferred embodiment according to the present invention.

First, please refer to FIG. 2. A heat exchanger 10 comprises a plurality of metal plates 11, each metal plate 11 has two contacting surfaces 12, and at least one of the contacting surfaces 12 has a fluid channel 13 and abuts against another metal plate, 11. The at least two metal plates 11 are connected together with the contacting surfaces 12 facing each other and melted together, as shown in FIG. 3. The combined metal plates 11 compose the heat exchanger 10 without locking or welding. Furthermore, a fluid input opening 14 and a fluid output opening 15 on the metal plate 11 enter from the contacting surface into the heat exchanger and are respectively connected to the fluid channels 13. Therefore, the fluid can be sent from the fluid input opening 14 into the heat exchanger 10 to fully flow through the fluid channel 13, and then sent out from the fluid output opening 15, as shown in FIG. 5, the continuous fluid flow can raise or lower the temperature of the applied unit.

The heat exchanger 10 comprises two metal plates 11 melted together, and the fluid channel 13 is disposed between the two metal plates 11.

The heat exchanger 10 comprises three metal plates 11 melted together, as shown in FIGS. 1-5, and a fluid channel 13 is mounted between each of two metal plates 11.

The heat exchanger 10 comprises multiple metal plates 11 melted together, and a fluid channel 13 is mounted between each of two metal plates 11.

Therefore, the heat exchanger 10 can be adjusted with different number of metal plate 11 for different operation.

The fluid input opening 14 and the fluid output opening 15 enter from the contacting surface 12 into the heat exchanger 10 and are respectively connected to the fluid channels 13.

The fluid input opening 14 and the fluid output opening 15 enter from sides of the metal plate 11 into the heat exchanger 10 and are respectively connected the fluid channel 13 and are respectively connected.

Furthermore, the fluid is a liquid fluid.

Alternatively, the fluid is a gaseous fluid.

The above-mentioned structure of the heat exchanger has the following advantages: first, the heat exchanger 10 is directly formed by melting the metal plates 11 together without locking or welding each metal plate 11 one by one, which reduces processing cost; second, the metal plates 11 of the heat exchanger 10 is melted together with the contacting surface, so that the heat exchanger 10 is seamless and there is no need to install the rubber gasket for sealing, and the heat exchanger 10 can withstand high pressure and is more resistant to acids and alkalis; last, the heat exchanger 10 does not need the rubber gasket, which makes the heat exchanger 10 more durable and does not require frequent repairs and maintenance to replace the rubber gasket.

Although the present invention has been explained in relation to its preferred embodiment, it is to be understood that many other possible modifications and variations can be made without departing from the spirit and scope of invention as hereinafter claimed.

What is claimed is:

1. A heat exchanger comprising a plurality of metal plates comprising at least a first metal plate, a second metal plate, and a third metal plate, each metal plate of the plurality of metal plates having two contacting surfaces, the first metal plate having a first contacting surface and an opposing second contacting surface, the second contacting surface having a recess defining a portion of a first fluid channel, the second metal plate having a third contacting surface and an opposing fourth contacting surface, the third contacting surface having a recess corresponding to the recess in the second contacting surface to define a remainder of the first fluid channel, the second contacting surface abutting against and connected to the third contacting surface to define the first fluid channel, the fourth contacting surface having a recess defining a portion of a second fluid channel, the third metal plate having a fifth contacting surface and an opposing sixth contacting surface, the fifth contacting surface having a recess corresponding to the recess in the fourth contacting surface to define a remainder of the second fluid channel, the fourth second contacting surface abutting against and connected to the fifth contacting surface to define the second fluid channel;

wherein:

a first opening extends from the first contacting surface to the recess in the second contacting surface to fluidically connect the first opening with the first fluid channel;

a second opening extends from the third contacting surface to the recess in the fourth contacting surface to fluidically connect the second opening with the second fluid channel; and a third opening separate from the first opening extends from the first contacting surface to the second opening to fluidically connect the third opening with the second fluid channel, the first opening not fluidically connected to the third opening.

2. The heat exchanger as claimed in claim 1, wherein the first metal plate and the second metal plate are melted together.

3. The heat exchanger as claimed in claim 1, wherein the first, second and third metal plates are melted together in series.

4. The heat exchanger as claimed in claim 1, wherein a fluid input opening and a fluid output opening enter from the first contacting surface of the first metal plate into the heat exchanger and are respectively connected together via the first fluid channel.

5. The heat exchanger as claimed in claim 1, wherein a fluid input opening and a fluid output opening enter from a side of the first metal plate into the heat exchanger and are respectively connected to the first fluid channel and are respectively connected together via the first fluid channel.

6. The heat exchanger as claimed in claim 1, wherein a fluid in the first fluid channel is a liquid fluid.

7. The heat exchanger as claimed in claim 1, wherein a fluid in the first fluid channel is a gaseous fluid.

* * * * *